US008132805B2

(12) United States Patent
Müller et al.

(10) Patent No.: US 8,132,805 B2
(45) Date of Patent: Mar. 13, 2012

(54) METHOD AND APPARATUS FOR FEEDING SHEETS TO A PROCESSING MACHINE

(75) Inventors: Andreas Müller, Heidelbeg (DE); Burkhard Wolf, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 120 days.

(21) Appl. No.: 12/501,787

(22) Filed: Jul. 13, 2009

(65) Prior Publication Data

US 2010/0007076 A1 Jan. 14, 2010

(30) Foreign Application Priority Data

Jul. 11, 2008 (DE) ..... 10 2008 032 756

(51) Int. Cl.
*B65H 5/22* (2006.01)

(52) U.S. Cl. ..... 271/3.24; 271/226; 271/270; 271/276

(58) Field of Classification Search ..... 271/7, 10.15, 271/248, 253, 194–197, 275–277, 3.23, 3.24, 271/270, 226
See application file for complete search history.

(56) References Cited

U.S. PATENT DOCUMENTS

| | | | | |
|---|---|---|---|---|
| 5,265,863 | A * | 11/1993 | Becker | 271/183 |
| 5,287,809 | A * | 2/1994 | Greive | 101/485 |
| 5,600,906 | A * | 2/1997 | Hamid | 38/143 |
| 5,851,009 | A | 12/1998 | Siebenmann | |
| 6,213,282 | B1 | 4/2001 | Mokler et al. | |
| 6,554,125 | B1 * | 4/2003 | Honegger | 198/460.1 |
| 7,011,305 | B2 * | 3/2006 | Forch et al. | 271/226 |

FOREIGN PATENT DOCUMENTS

| | | | |
|---|---|---|---|
| AT | 385260 | B | 3/1988 |
| DE | 8024142 | U1 | 2/1981 |
| DE | 19814141 | A1 | 10/1999 |
| EP | 1522513 | A2 | 4/2005 |

OTHER PUBLICATIONS

German Search Report dated Mar. 30, 2009.

* cited by examiner

*Primary Examiner* — Michael McCullough
(74) *Attorney, Agent, or Firm* — Laurence A. Greenberg; Werner H. Stemer; Ralph E. Locher

(57) ABSTRACT

In a method and an apparatus for feeding sheets to a processing machine, in particular a printing press, provision is made for the sheet to be accelerated to processing speed by use of at least two acceleration stations arranged one after the other. One of the acceleration stations is arranged such that the acceleration station can be displaced in order to align the sheet.

7 Claims, 4 Drawing Sheets

METHOD AND APPARATUS FOR FEEDING SHEETS TO A PROCESSING MACHINE

CROSS-REFERENCE TO RELATED APPLICATION

This application claims the priority, under 35 U.S.C. §119, of German application DE 10 2008 032 756.5, filed Jul. 11, 2008; the prior application is herewith incorporated by reference in its entirety.

BACKGROUND OF THE INVENTION

Field of the Invention

The invention relates to a method and an apparatus for feeding sheets to a sheet-processing machine, in particular a printing press.

In this case, the sheets are fed in overlapping formation to an acceleration station, by which they are accelerated to processing speed and aligned.

German patent DE 198 14 141 C2, corresponding to U.S. Pat. No. 6,213,282, already shows an apparatus for feeding flat goods, for example sheet metal panels, to a processing machine. In this case, the flat goods are fed one after another to various retardation stations and alignment stations.

The sheet metal panels are fed correspondingly slowly at a low processing speed.

SUMMARY OF THE INVENTION

It is accordingly an object of the invention to provide a method and an apparatus for feeding sheets to a processing machine that overcomes the above-mentioned disadvantages of the prior art devices and methods of this general type. The invention is based on the object of accelerating sheets transported in overlapping formation to a processing speed of the processing machine, for example a printing press, and of aligning them during the acceleration operation.

With the foregoing and other objects in view there is provided, in accordance with the invention, a method for feeding sheets to a sheet-processing machine. The method includes the steps of: feeding the sheets in an overlapping formation on a feed table to a first acceleration station and the sheets are accelerated by the first acceleration station; and feeding the sheets to at least one second acceleration station and the sheets are accelerated by the second acceleration station to a machine speed of the sheet-processing machine, before they are fed to sheet gripper devices of a feed cylinder of the sheet-processing machine.

A particular advantage of the invention is that the sheets can be fed at very high transport speeds (for example more than 20,000 sheets per hour) to a processing machine, in particular a printing press.

No stationary stops are needed to align the sheets.

Particularly advantageous is the arrangement of two or more acceleration stations arranged one after the other, one, preferably the first, simultaneously carrying out an alignment function.

A further advantage is the conditioning of the sheet before the transfer to gripper devices of a first feed cylinder of the sheet-processing machine, by use of a number of transport belts arranged at a distance beside one another. As a result of this measure, the sheet can be transferred to the grippers having been evened out and without creasing.

All the acceleration and alignment stations have transport belts to which vacuum can be applied. The application of vacuum can preferably be controlled at the cycle rate of the sheet-processing machine.

Other features which are considered as characteristic for the invention are set forth in the appended claims.

Although the invention is illustrated and described herein as embodied in a method and an apparatus for feeding sheets to a processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
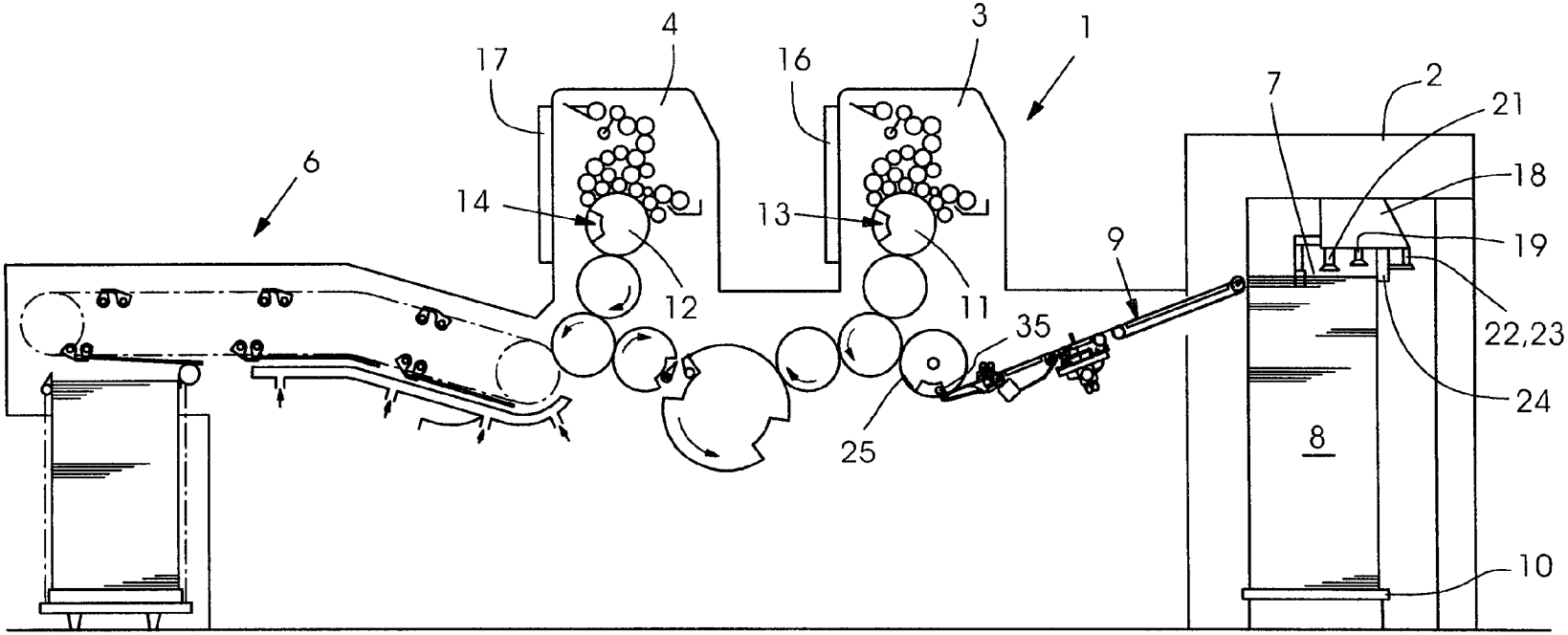
FIG. 1 is a diagrammatic, side sectional view of a sheetfed rotary printing press.

Referring now to the drawings of the invention in detail, and in particular to FIG. 1 thereof, there is shown a machine for processing sheets 7, for example a printing press 1, that has a feeder 2, at least one printing unit 3 and 4 and a deliverer 6. The sheets 7 are taken from a sheet stack 8 and fed in overlapping formation over a feed table 9 to the printing units 3 and 4. The latter each contain, in a known manner, a plate cylinder 11, 12. The plate cylinders 11 and 12 each have an apparatus 13, 14 for fixing flexible printing plates.

Furthermore, each plate cylinder 11, 12 is assigned an apparatus 16, 17 for the semiautomatic or fully automatic printing plate change.

The sheet stack 8 rests on a stack board 10 that can be raised under control. The removal of the sheets 7 is carried out from the top of the sheet stack 8 by what is known as a suction head 18 which, among other things, has a number of lifting and dragging suckers 19, 21 for separating and overlapping the sheets 7. Moreover, blowing devices 22 are provided in order to loosen the upper sheet layers, as are sensing elements 23 for stack tracking. To align the sheet stack 8, in particular the upper sheets 7 of the sheet stack 8, a number of side and rear stops 24 are provided.

Figure 2:
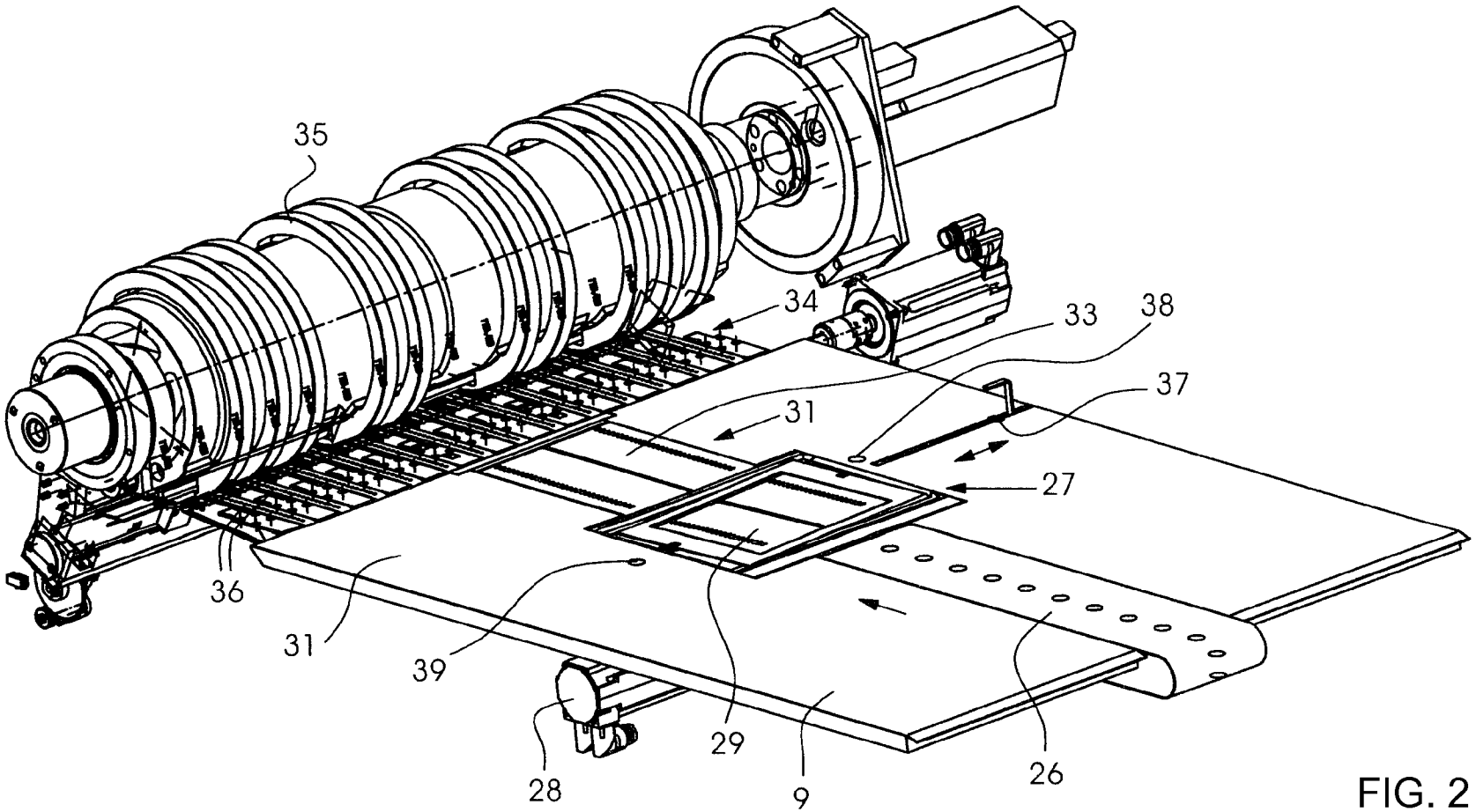
FIG. 2 is a diagrammatic, perspective view of a feed device according to the invention.

In order to transport the overlapping stream, the feed table 9 has at least a first transport belt 26 (FIG. 2), which is formed as what is known as a "suction belt" and can preferably be driven continuously at a cycle rate of the sheet-processing machine by a drive motor or by the feeder of the printing press.

Arranged downstream of the transport belt 26 in the sheet transport direction (arrow in FIGS. 2, 3, 4) is a first acceleration station 27. The first acceleration station 27 has an individual drive 28 that can be activated independently of the drive of the transport belt 26. The acceleration station 27 has at least one transport belt 29, which is formed as a "suction belt" and can have vacuum applied to it as a function of the position of the sheet to be accelerated.

Arranged downstream of the first acceleration station 27 is at least one second acceleration station 31. The second acceleration station 31 has a drive 32 and substantially contains at least one transport belt 33 to which vacuum can be applied.

Arranged downstream of the second acceleration station 31 is a transport station 34, which has a number of suction belts 36 arranged at a distance beside one another, which can be driven jointly by a drive 30 at the speed of the sheet-processing machine and support and transport the sheet 7 to be fed over its entire width, until the sheet is gripped by gripper devices 35 of a feed cylinder 25. The suction belts 36 can have vacuum applied to them jointly, the application of vacuum being controllable at the cycle rate of the sheet-processing machine.

In order to align the sheet 7 to be fed, the transport belt 29 of the first acceleration station 27 is constructed such that it can be adjusted obliquely and displaced sideways.

In order to grip a side edge of the sheet 7, a sensor 37 that can be adjusted to the transverse format to be processed is provided and, in the sheet transport direction, is arranged in the region of the first alignment station 27.

Two further sensors 38, 39 register the leading edge of the sheet 7 approximately at the same height and at the same time as the sensor 37 and, following a desired-actual value comparison, control a drive 40 for the oblique positioning of the transport belt 29 and the first acceleration station 27. A correction to the lateral position of the transport belt 29 and the first acceleration station 27 is carried out by using a desired-actual value comparison of the values of the position of the sheet, which are determined by the sensor 37.

After the sheet has been accelerated and aligned with respect to the speed in the overlapping stream, it is gripped by the second acceleration station 31 and accelerated to machine speed.

Arranged downstream of the second acceleration station 31 or the further acceleration stations is the transport station 34, which is driven at machine speed. The transport station 34 contains a number of transport belts 36 arranged at a distance beside one another, which are arranged in the feed table 9, distributed over the maximum format width to be processed. The transport belts 36 grip the sheet over its entire width and condition and even out the latter, so that the sheet 7 can be transferred without any stresses to the gripper device 35 of the feed cylinder 25.

Figure 3:
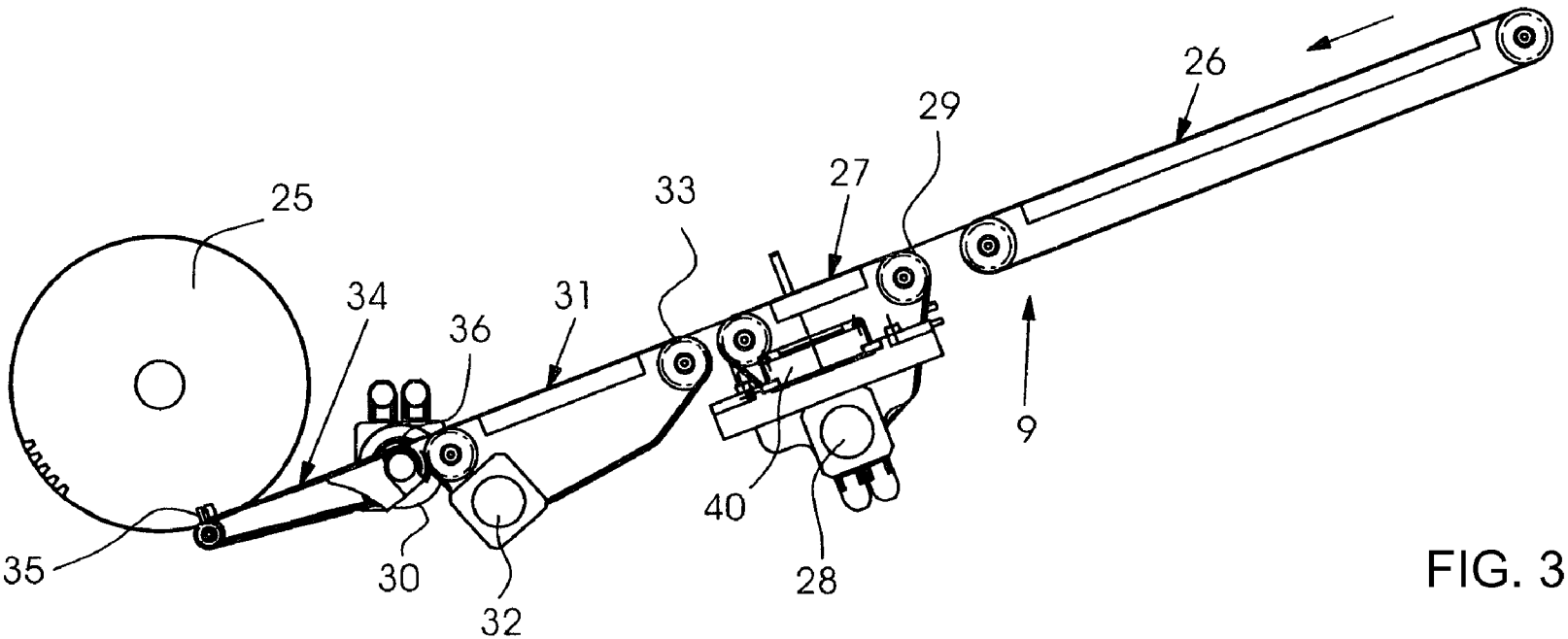
FIG. 3 is a sectional view of the feed device.
Figure 4:
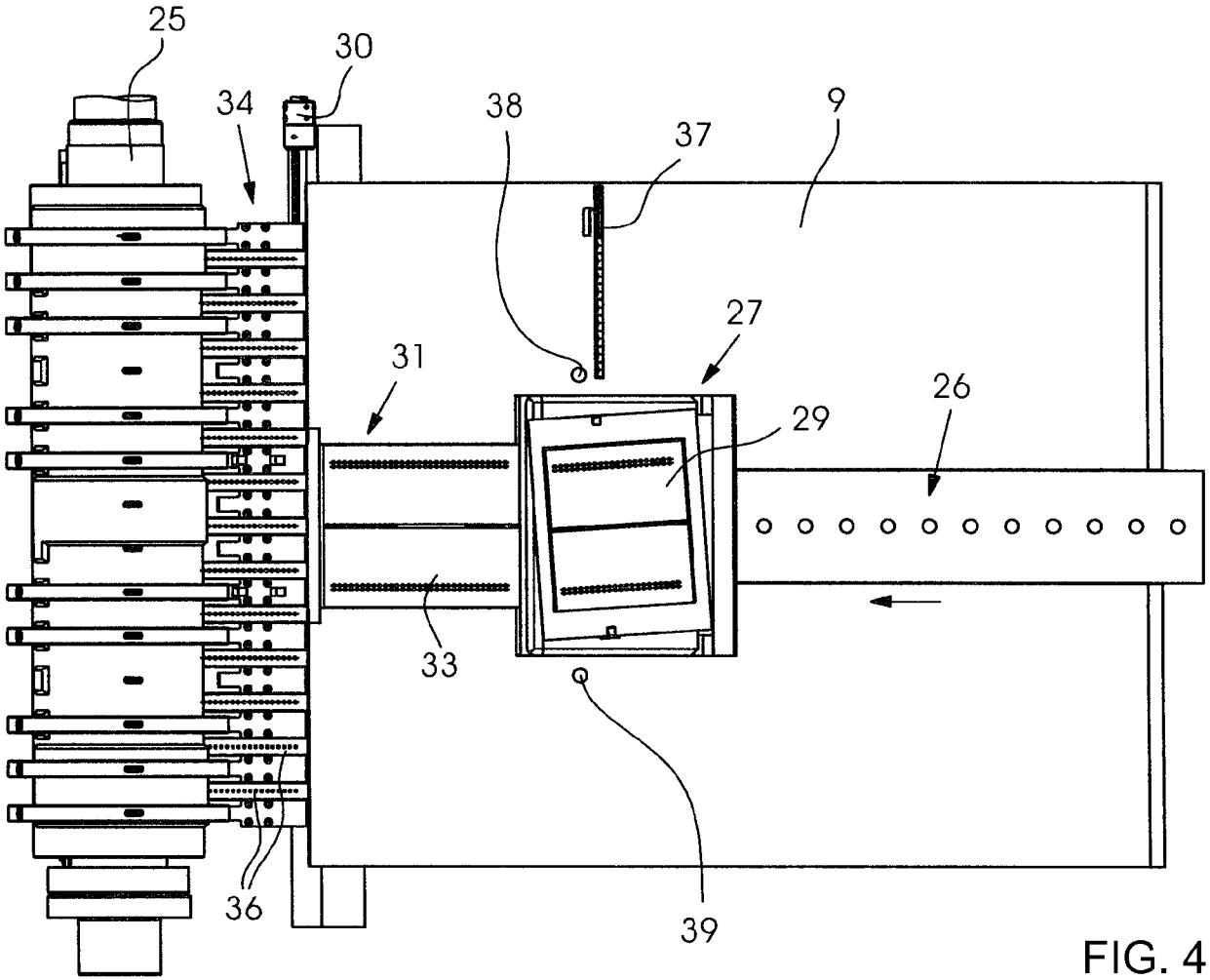
FIG. 4 is a plan view of the feed device.

In the preferred exemplary embodiment according to FIG. 3, an additional sensor 41 is provided to detect the lateral position of the sheet. Following a desired-actual value comparison, the sheet can be aligned sideways once more on the feed cylinder 25.

The invention claimed is:

1. A method for feeding sheets to a sheet-processing machine, which comprises the steps of:

feeding the sheets in an overlapping formation on a feed table to a first acceleration station and the sheets being accelerated by the first acceleration station;

providing a skewed position correction to the sheets by the first acceleration station as the sheets are accelerated;

feeding the sheets to at least one second acceleration station and the sheets being accelerated by the at least one second acceleration station to a machine speed of the sheet-processing machine, before the sheets are fed to sheet gripper devices of a feed cylinder of the sheet-processing machine; and feeding the sheets via a transport device that is driven continuously at a cycle rate of the sheet-processing machine to the gripper devices of the feed cylinder of the sheet-processing machine, after the sheets have been accelerated to the machine speed.

2. The method according to claim 1, which further comprises aligning the sheets sideways in a transport plane by the first acceleration station, as the sheets are accelerated.

3. An apparatus for feeding sheets to a sheet-processing machine, the apparatus comprising:

a feed table on which the sheets are transported in overlapping formation;

a first acceleration station for a sheet, said first acceleration station disposed in said feed table, said first acceleration station being adjustably mounted to said feed table for sheet alignment;

at least one second acceleration station for the sheet disposed downstream of said first acceleration station; and a transport device for being driven at a cycle rate of the sheet-processing machine, said transport device being disposed downstream of said first and at least one second acceleration stations.

4. The apparatus according to claim 3, wherein said transport device and said first and at least one second acceleration stations have transport belts.

5. The apparatus according to claim 4, wherein said transport belts are assigned suction apparatuses for applying vacuum individually to said transport belts.

6. The apparatus according to claim 4, wherein said first acceleration station is adjustably mounted to said feed table for adjustment in an oblique direction relative to a transport plane.

7. The apparatus according to claim 4, wherein said first acceleration station is adjustably mounted to said feed table for adjustment in a sideways direction on a transport plane.

* * * * *